US010862219B2

(12) United States Patent
Haziza et al.

(10) Patent No.: US 10,862,219 B2
(45) Date of Patent: Dec. 8, 2020

(54) MULTI-LAYER LIQUID CRYSTAL PHASE MODULATOR

(71) Applicant: Wafer LLC, Hanover, NH (US)

(72) Inventors: Dedi David Haziza, Kiryat Motzkin (IL); Eliyahu Harush, Mizpe Aviv (IL)

(73) Assignee: WAFER LLC, Hanover, NH (US)

( * ) Notice: Subject to any disclaimer, the term of this patent is extended or adjusted under 35 U.S.C. 154(b) by 113 days.

(21) Appl. No.: 16/175,541

(22) Filed: Oct. 30, 2018

(65) Prior Publication Data

US 2019/0131719 A1 May 2, 2019

Related U.S. Application Data

(60) Provisional application No. 62/579,053, filed on Oct. 30, 2017.

(51) Int. Cl.

| | |
|---|---|
| ***H01Q 1/38*** | (2006.01) |
| ***H01Q 9/04*** | (2006.01) |
| ***H01P 1/18*** | (2006.01) |
| ***H01Q 21/06*** | (2006.01) |
| ***H01Q 21/00*** | (2006.01) |
| ***H01Q 3/44*** | (2006.01) |

(52) U.S. Cl.

CPC ..... *H01Q 21/065* (2013.01); *H01Q 3/44* (2013.01); *H01Q 21/0006* (2013.01); *H01Q 21/0037* (2013.01)

(58) Field of Classification Search

CPC .. H01Q 21/0006; H01Q 21/06; H01Q 21/061; H01Q 21/065; H01Q 21/0037; H01Q 21/0087; H01Q 21/00; H01Q 3/34; H01Q 3/44; H01Q 1/38; H01Q 9/04; H01Q 13/00; H01Q 3/22; H01P 1/18; H01P 3/08

See application file for complete search history.

(56) References Cited

U.S. PATENT DOCUMENTS 4,843,353 A * 6/1989 Sequeira ..... H01P 1/10 333/248
5,721,194 A * 2/1998 Yandrofski ..... H01Q 3/44 505/210
6,081,235 A * 6/2000 Romanofsky ..... H01P 1/181 333/156

(Continued)

FOREIGN PATENT DOCUMENTS

JP 2000-236207 A 8/2000
JP 2000-315902 A 11/2000

(Continued)

OTHER PUBLICATIONS

International Search Report and Written Opinion dated Jan. 16, 2019, for PCT/US2018/058266, filed Oct. 30, 2018, 8 pages.

(Continued)

*Primary Examiner* — Tho G Phan

(74) *Attorney, Agent, or Firm* — Womble Bond Dickinson (US) LLP; Joseph Bach, Esq.

(57) ABSTRACT

An antenna comprising: a variable dielectric constant (VDC) layer; a plurality of radiating patches provided over the VDC layer; a plurality of signal lines, each terminating in alignment below one of the radiating patches; a plurality of control lines, each corresponding to one of the signal lines; a ground plane; wherein the VDC layer comprises a plurality of liquid crystal sublayers stacked on each other.

19 Claims, 5 Drawing Sheets

(56) References Cited

U.S. PATENT DOCUMENTS

| | | | | |
|---|---|---|---|---|
| 6,335,699 | B1 | 1/2002 | Honma | |
| 6,930,639 | B2 * | 8/2005 | Bauregger | H01Q 1/38 343/700 MS |
| 7,466,269 | B2 * | 12/2008 | Haziza | H01Q 3/36 343/700 MS |
| 10,326,205 | B2 * | 6/2019 | Haziza | H01Q 9/0442 |
| 2008/0036664 | A1 | 2/2008 | Haziza | |
| 2008/0309578 | A1 | 12/2008 | Son et al. | |
| 2009/0278744 | A1 | 11/2009 | Kirino et al. | |
| 2014/0266897 | A1 | 9/2014 | Jakoby et al. | |

FOREIGN PATENT DOCUMENTS

| | | | |
|---|---|---|---|
| JP | 2003-017912 | A | 1/2003 |
| JP | 2004-023228 | A | 1/2004 |

OTHER PUBLICATIONS

Dolfi, D., et al., "Liquid Crystal Microwave Phase Shifter," Electronics Letters, vol. 29, No. 10, May 13, 1993.

Transmittal of International Preliminary Report on Patentability for PCT/US2018/058266, filed Oct. 30, 2018, dated May 5, 2020, 6 pages.

* cited by examiner

Figure 1 – Prior Art

MULTI-LAYER LIQUID CRYSTAL PHASE MODULATOR

CROSS-REFERENCE TO RELATED APPLICATION

This application claims priority from U.S. Provisional Application No. 62/579,053, filed Oct. 30, 2017, the disclosure of which is incorporated herein by reference in its entirety.

BACKGROUND

1. Field

This disclosure relates generally to liquid crystal phase modulators and antenna devices and, more specifically, to the use of multi-layered liquid crystal to control electrical property of an RF device, such as an antenna.

2. Related Art

In recent years, wireless communication systems related applications are increasing in different fields. Future applications require the use of antenna with a multiband and wideband capabilities. Phase modulators, and in particular antennas, should have low profile, light weight, low cost and ease of integration with microwave devices, etc. Unlike current antenna design, which includes a large mechanical rotating dish, in order to incorporate antennas in next generation telecommunication hardware a small size antenna with omni-directional radiation pattern, wide bandwidth and stable gain is preferred. The use of variable dielectric constant materials, specifically liquid crystal (LC) has been proposed in previous work. Such antenna generates a scanning RF beam according to the applied electrical field force and direction, which can be controlled by software. In this manner a focal plane scanning antenna, or a phase shifter in general, is able to maintain its low profile and size, without the use of mechanically moving parts. See, e.g., U.S. Pat. No. 7,466,269; US 2014/0266897; US 2018/0062268; and US 2018/0062238.

For applications where the wavelength of the operating device is in the microwave range, the required active layer thickness, i.e., the thickness of the variable dielectric material (such as liquid crystal), is required to be quite high, 50-200 μm, 200-500 μm, 1000 μm and even up to several millimeters. In addition, the response times of the antenna/phase shifter device, (τon, τoff), need to be adequate to support packet-based beam forming. Various applications, such as a scanning focal plane array antenna which is tracking a fast-moving target, or required to monitor several moving q stationary targets at the same time, the response times should be reduced even further, e.g., to 1 μs or lower. However, the increase in the active layer thickness results in an increase in the response times of the system. In a phase shifter/antenna device based on nematic liquid crystal materials, or oven ferroelectrics, the response times are correlated to the active layer thickness (r) by a general equation: $\tau_{on} \propto r^2$, which means that a device operating with a very thick active layer cannot reach ultra-fast response times, per system requirement.

SUMMARY

The following summary of the disclosure is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Disclosed aspects of the present invention provide an RF device, e.g., antenna or a phase shifter, variable dielectric-constant (VDC) material layer and a method for manufacturing such a device, whereas the VDC layer is made of multiple stacked sub-layers, thus providing improved performance and switching time.

A further aspect of the present invention is to provide an antenna or an RF device comprising multiple layers of liquid crystal or other variable dielectric material, separated by a thin film or micro-structures, and a method for manufacturing such a device, whereas the device homogeneously aligns the liquid crystal material between two alignment layers.

Another aspect of the present invention is to provide a differential voltage between the separating multiple VDC films, in order to create a uniform electric field between the top and bottom of the antenna device, in order to affectively change the dielectric constant of the liquid crystal.

A further aspect of this invention is to reduce the required voltage needed to affectively rotate the liquid crystal molecules, by applying the voltage in multiple thin VDC layers, 5-10 μm, or 10-20 μm, 20-50 μm and possibly up to 50-500 μm.

Another aspect of the invention is to dramatically reduce the insertion losses of the transmission line implemented as the core component for the true time delay device. The thickness of the overall VDC layer control that loss, the lower the height of the VDC layer the lower the loss.

In its generic aspect, an antenna is provided which comprises: a variable dielectric constant (VDC) layer; a plurality of radiating patches provided over the VDC layer; a plurality of signal lines, each terminating in alignment below one of the radiating patches; a plurality of control lines, each corresponding to one of the signal lines; a ground plane; wherein the VDC layer comprises: a plurality of sub-layers stacked one top of each other and separated from each other by thin films.

BRIEF DESCRIPTION OF THE DRAWINGS

Other aspects and features of the invention would be apparent from the detailed description, which is made with reference to the following drawings. It should be appreciated that the detailed description and the drawings provides various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 1 is a cross-sectional schematic drawing of a prior art device;

FIG. 1B is an embodiment having two signal lines coupled to each radiating patch, while

FIG. 1D is a cross-sectional of an embodiment having two VDC layers and two ground planes, while

FIG. 1H illustrates a cross-section of an embodiment of a two-dimensional array antenna, while

FIG. 2 illustrates a cross-section of a VDC made of multiple sub-layer, according to the embodiments of the invention, while

DETAILED DESCRIPTION

Figure 2:
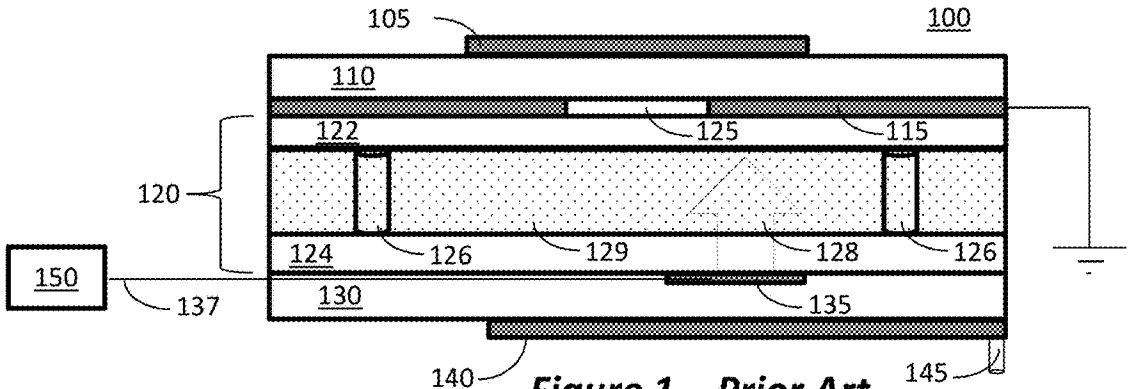
Figure 2:
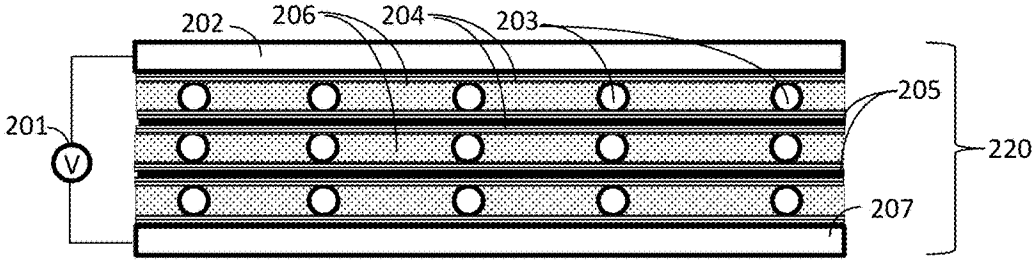

Embodiments of the inventive RF device will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

FIG. 1 illustrates a prior art RF device, in this example an antenna 100. The antenna 100 has a radiating patch 105, generally in the form of a copper patch formed or adhered to dielectric 110. FIG. 1 illustrates a single radiating path, but generally the antenna will have a two-dimensional array of radiating patches, such that FIG. 1 can be considered as illustrating only a section of the antenna. Dielectric 110 may be, e.g., Rogers® circuit board material, glass, PET, Teflon, etc. A ground plane 115 is provided between the bottom of dielectric 110 and the VDC layer 120. A coupling window 125 is formed in the ground plane and is used to couple RF energy between the radiating patch 105 and the signal line 140. The signal line is coupled to an output port, e.g., a coaxial F connector. Thus, RF signal is capacitively coupled between the signal line 140 and radiating patch 105, via the intervening dielectric layer formed by the VDC layer 120. The VDC layer 120 is formed by a top dielectric layer/film 122, a bottom dielectric layer/film 124, spacers 126, and liquid crystals 128 dispersed among the spacers. Note also that the ground plane 115, the VDC layer 120, and the signal line 140 form a capacitor, the characteristics of which depends on the dielectric constant value of the VDC layer 120.

Incidentally, as the VDC layer may be formed using liquid crystals, as a shorthand the layers may also be referred to herein as liquid crystal (LC) layers or sublayers. Similarly, when referring to the VDC material, as a shorthand the terminology liquid crystal may be used.

FIG. 2 illustrates an embodiment of the overall multi-layer construction of a VDC layer 220 that may be used in any device that uses the prior art VDC layer, such as VDC layer 120 shown in FIG. 1. In FIG. 2, power supplier 201 is shown applying voltage across the top and bottom electrodes 202 and 207, but in practice the structure shown would be formed as part of the RF device, as shown in the other embodiments disclosed herein. The overall VDC layer 220 is formed of a plurality of thin LC sub-layers that are stacked together. Each of the individual VDC sublayers may have spacers 203 inserted between and separating dielectric films 205. The liquid crystals 206 are dispersed among the spacers 203 between a top and bottom dielectric films 205. Alignment layers 204 are provided to form the alignment force for the LC. The effective dielectric constant, Et, can be calculated using the individual dielectric constants and the individual heights of each layer, as:

$$Et=E1^{(h_1/H_t)}*E2^{(h_2/H_t)}*E3^{(h_3/H_t)};$$

where $h_i$ is the height of each individual sub-layer and $H_t$ is the total height.

The number and thickness of the sub-layers can be designed so as to provide the desired effective dielectric constant. However, since the VDC layer is formed of multiple sub-layers, the effective delta ε ($\Delta\varepsilon=\varepsilon_{\parallel}-\varepsilon\perp$) is improved, since the director of each layer is better aligned both in the off and on conditions. Moreover, the response time is improved.

Figure 1A:
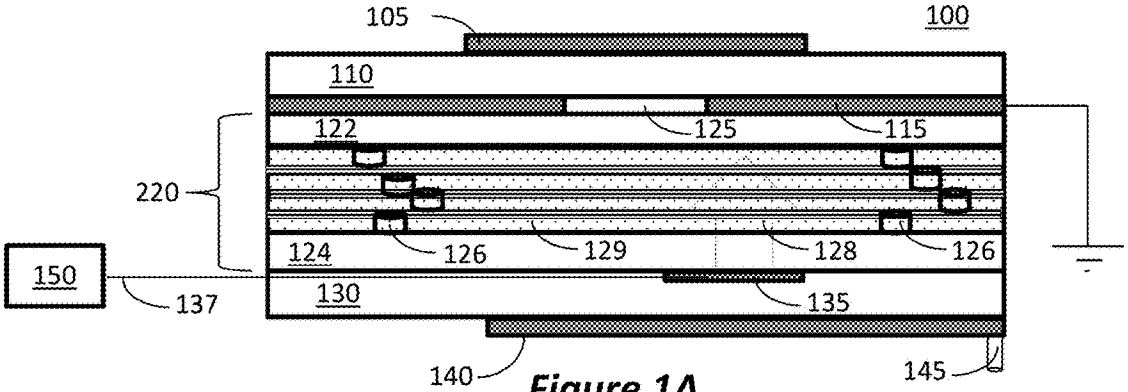
FIG. 1A is a cross-sectional of one embodiment of an antenna using multiple VDC sub-layers.

FIG. 1A, illustrates an embodiment combining the multiple VDC sub-layers structure shown in FIG. 2 with the antenna illustrated in FIG. 1. The elements of FIG. 1A that are similar to those in FIG. 1 have the same reference numerals. As shown in FIG. 1A, the VDC layer 220 is made up of three sub-layers, that are stacked together. The number of sublayers and the thickness of each sublayer can be designed in order to achieve the required performance, such as the required dielectric constant in the on and off conditions, and the switching response time. When needed, spacers 126 may be used in some or all of the sublayers, such that the thickness of each sublayer is maintained according to the required specifications.

As shown in FIG. 1A, electrode 135 is coupled via control line 137 to a controller 150, which applies an AC, a DC, or a square-wave DC potential to the electrode 135. When the controller applies potential to the electrode 135, an electric field (indicated by the broken-line arrow) is formed, which causes the liquid crystals 128 in the vicinity of the electrode 135 in each of the sublayers to rotate in an amount corresponding to the applied potential. Consequently, the characteristics of the capacitor formed between the ground plane 115 and the signal line 140 changes. This can be used to control the RF signal traveling in the signal line 140, e.g., to cause a delay or phase shift in the signal.

In the example of FIG. 1A, only one radiating patch and one signal line are shown, but this arrangement can be repeated in a two-dimensional array to thereby form an electronically steerable antenna. In such an arrangement, multiple control lines can be provided, one for each of the signal lines. Also, the ground plane would have multiple coupling windows, one corresponding to each signal line and its corresponding radiating patch.

Thus, according to one embodiment, an antenna is provided, comprising: a dielectric plate; at least one radiating patch provided on the dielectric plate; a ground plane having at least one window, wherein each radiating patch is aligned with one window; at least one signal line, wherein each signal line is configured for capacitively coupling RF signal to one radiating patch; and a liquid crystal layer provided between the signal line and the ground plane and comprising a plurality of liquid crystal sublayers stacked together and each made of a top dielectric film, a bottom dielectric film, a plurality of spacers provided between the top dielectric film and bottom dielectric film, and liquid crystals dispersed among the spacers. The spacers may be made of, e.g., glass, PS (polystyrene), PE (polyethylene), PP (polypropylene), PMMA, Silica, Cellulose acetate, Zirconia.

Figure 1C:
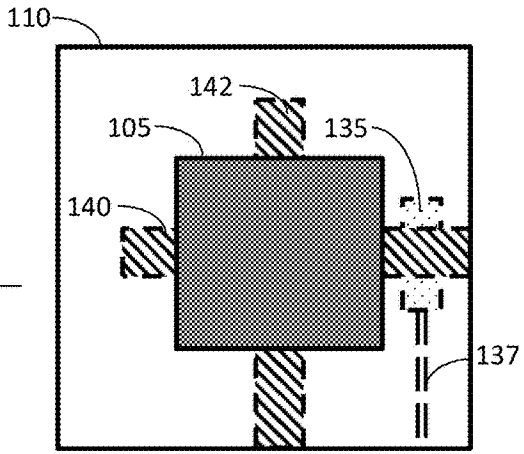
FIG. 1C is a top view thereof.
Figure 1B:
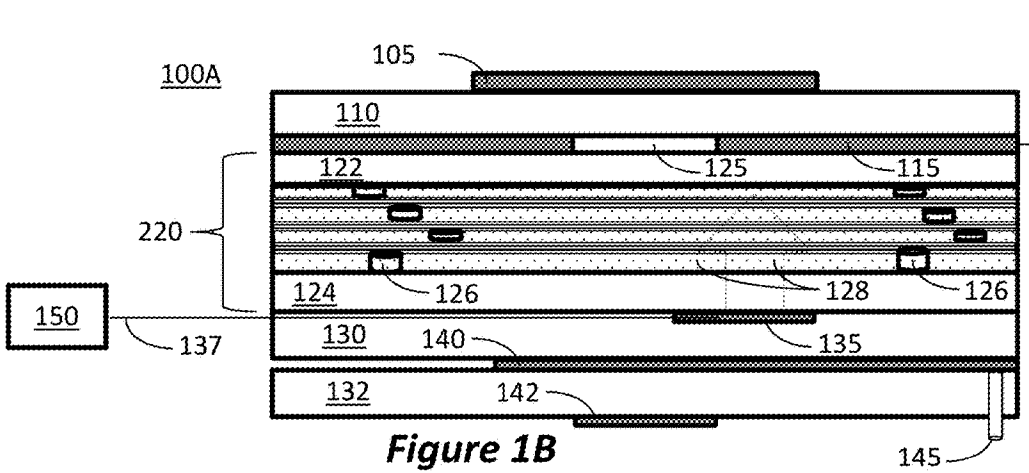

FIGS. 1B and 1C illustrate an embodiment wherein each radiating patch has two signal line coupled to it, wherein the two signal lines are orthogonal to each other. The elements of the embodiment of FIGS. 1B and 1B are the same as in the embodiment of FIG. 1A, except that another dielectric layer 132 is provided below the first signal line 140, and an orthogonal second signal line 142 is provided below the second dielectric layer 132. In this embodiment, one signal line can be used for transmission while the other signal line can be used for reception. In another implementation both signal lines can be used to generate a circularly polarized signal by applying the control signal to electrode 135 in a manner that delays the signal in one of the signal lines with respect to the other. Of course, as with the embodiment of FIG. 1A, the embodiment of FIGS. 1B and 1C can be implemented using a plurality of radiating patches and corresponding signal and control lines.

As shown in the example of FIG. 1B, the multiple sublayers need not be of the same thickness. Each layer may be designed and fabricated to be at different thickness, e.g., using different thickness spacers 126.

Figure 1E:
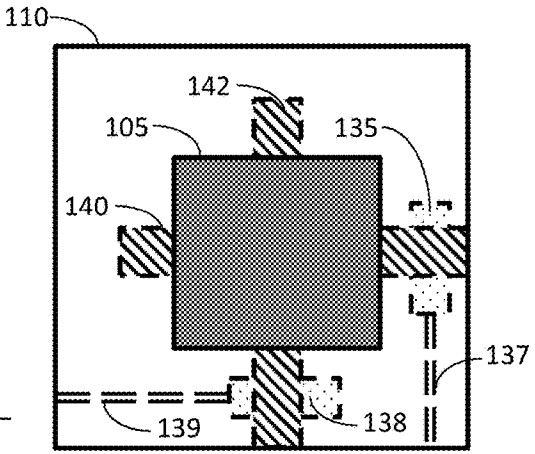
FIG. 1E is a top view thereof.
Figure 1D:
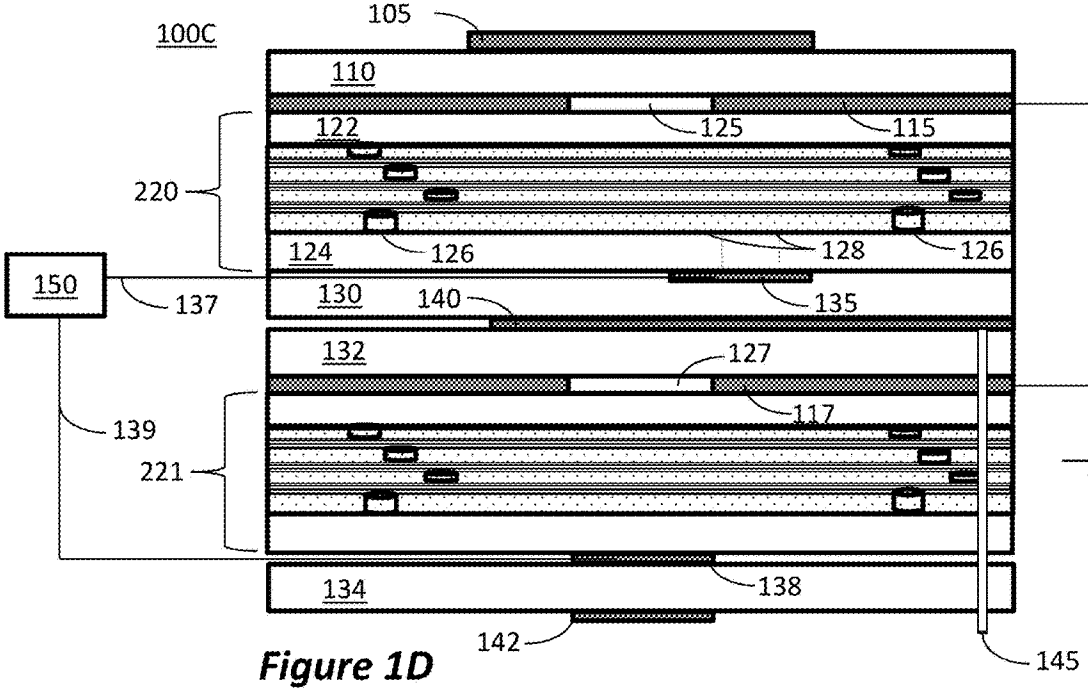

FIGS. 1D and 1E illustrate an embodiment wherein the transmission characteristics of each signal lines 135, 142, can be controlled independently. Notably, this embodiment utilizes two VDC layers 220 and 221, each or both may be made of multiple sublayers. Also, this embodiment utilizes multiple ground planes, each having windows aligned to couple RF signal between the radiating patch and the corresponding signal line. The arrangement can be implemented with multiple radiating patches, just as with the other embodiments. When implemented as a two-dimensional array, the beam can be steered in any direction in hemisphere space by the control signals applied to the multiple control lines, so as to independently control the delay applied to each signal line.

As illustrated in FIG. 1D, the signal propagating in signal line 140 is controlled by applying control signal to electrode 135, thus rotating the liquid crystals in the stacked multilayer VDC 220, and the signal propagating in signal line 142 is controlled by applying control signal to electrode 138, thus rotating the LC in the stacked multilayer VDC 221. Thus, in one example the signals are delayed by 90° with respect to each other, so as to generate circular polarization.

The embodiment of FIGS. 1D and 1E provide an antenna having multiple VDC layers and multiple ground planes, comprising: a top dielectric layer; a plurality of radiating patches provided over the top dielectric layer; a first liquid crystal layer positioned below the top dielectric layer; a first ground plane having a plurality of windows, each window aligned with one of the radiating patches; a plurality of first signal lines each terminating in alignment with one of the radiating patches; a plurality of first control lines, each aligned with one of the first signal lines; a second liquid crystal layer; a second ground plane having a plurality of windows, each aligned with one of the radiating patches; a plurality of second signal lines each terminating in alignment with one of the radiating patches; and a plurality of second control lines, each aligned with one of the first signal lines; wherein each of the first and second liquid crystal layers comprises a plurality of sublayers stacked together, each sublayer having a top dielectric, a bottom dielectric, a plurality of spacers provided between the top dielectric and bottom dielectric, and a plurality of liquid crystals dispersed between the top and bottom dielectrics.

In some embodiments the layers are arranged in the order, top to bottom: radiating patches, top dielectric layer, first ground plane, first liquid crystal layer, first control lines, first signal lines, second ground plane, second liquid crystal layer, second control lines and second signal lines. Also, as illustrated, various intermediate dielectric layers are provided between the various signal lines, control lines and ground planes. It should be noted, however, that the illustrated order of layers is not mandatory and other orders can be utilized. For example, FIG. 1F illustrates an embodiment having multiple VDC layers and multiple ground planes, but in a different order than that of FIG. 1D.

Figure 1F:
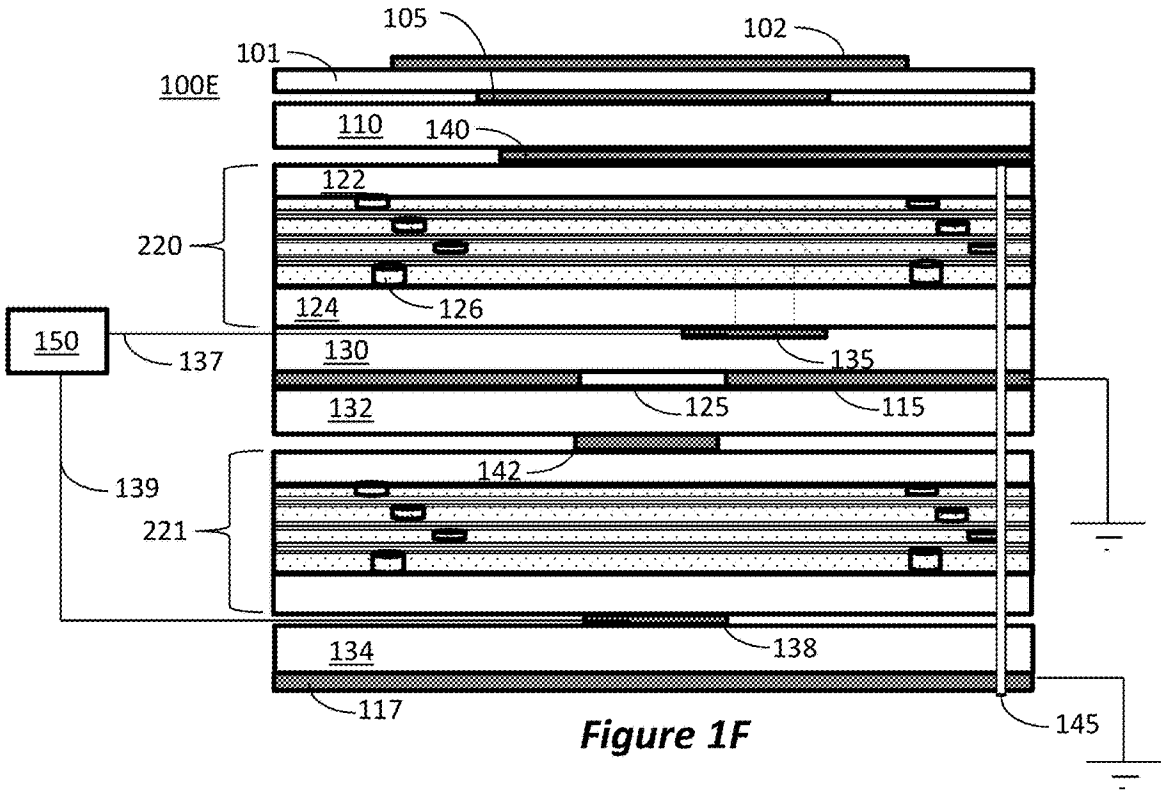
FIG. 1F is a cross-sectional of an embodiment having modified layers order.

FIG. 1F illustrates an embodiment similar to that of FIG. 1D, except that the order of layers is different. In FIG. 1F, the first signal line 140 is provided below the radiating patch 105, but above the first ground plane 115 and above the first VDC layer 220. The first control line 135 may be provided above or below the first VDC layer 220. The first ground plane 115 is provided below the first VDC layer 220. While in this embodiment the first ground plane 115 has window 125, the window 125 is for coupling the signals to the second signal line 142 and is therefore aligned for the second signal line 142, not the first signal line 140. The signal for the first signal line 140 is coupled directly to the radiating patch 105 through the top dielectric 110.

As indicated, the window 125 in the first ground plane is aligned to couple the RF signal from the second signal line 142, since the second signal line 142 is below the first ground plane, but is above the second VDC layer 221. The second ground plane 117 is provided below the second signal line 142 and, therefore, requires no windows. The second control line 138 may be provided below or above the second VDC layer 221.

Therefore, an RF antenna having multiple ground planes and multiple variable dielectric layers is provided, comprising: a top dielectric layer; a plurality of radiating patches provided over the top dielectric; a first variable dielectric constant (VDC) layer; a first ground plane having a plurality of windows, each aligned with one of the radiating patches; a plurality of first signal lines, each terminating below one of the windows of the first ground plane; a plurality of first control lines, each configured to control liquid crystal domains of the first VDC layer in vicinity of one of the first signal lines; a second VDC layer provided below the first VDC layer; a second ground plane having a plurality of windows, each aligned with one of the radiating patches; a plurality of second signal lines, each terminating below one of the windows of the second ground plane; and a plurality of second control lines, each configured to control liquid crystal domains of the second VDC layer in vicinity of one of the second signal lines.

In fabricating the sublayers for the VDC layer of the RF devices, the two opposing dielectric substrates which encapsulate the liquid crystals can be made of any non-conduction material desired, whether transparent or opaque, since there are no optical considerations. The control electrodes can be made by, e.g., deposition such as evaporation, electroplating, electroless plating, etc., may be printed on using conducting ink or paste, etc. As shown in the embodiments disclosed herein, the control electrodes may be positioned on either side of the liquid crystals to generate the electrical field as required for the function of the RF device. The control electrode and signal line materials can be a type of conduction material, specifically metal, such as gold (Au), silver (Ag), Titanium (Ti), Copper (Cu), Platinum (Pt), or other metals and/or metals layering or alloying. In between the two substrates, spacers made of insulating material may be placed to fix and maintain the desired cell gap.

Figure 3:
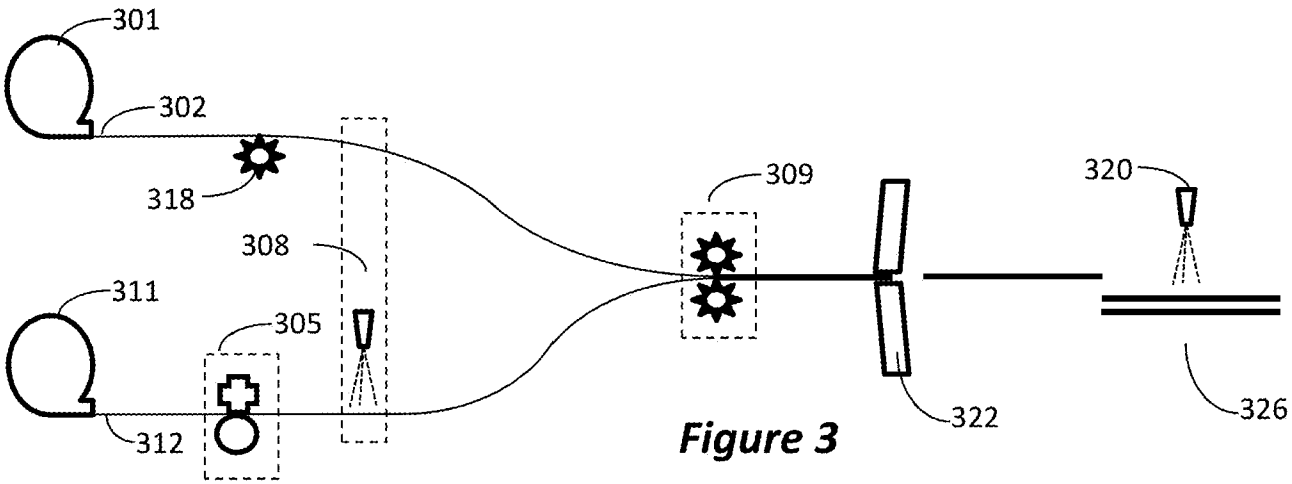
FIG. 3 illustrates an embodiment for manufacturing the VDC layer.

The liquid crystals sublayers can be produced by roll to roll methods or using pre-cut thin dielectric sheets. FIG. 3 illustrates a roll-to-roll method of manufacturing the VDC sublayers according to an embodiment of the invention. In FIG. 3, supply roll 301 provides a continuous strip of flexible insulating material 302, e.g., PET, polymer nanocomposites, Pyralux® (Available from Du Pont), ECCOSTOCK® low loss dielectrics (Available from Emerson & Cuming of Laird PLC, London, England), etc. Meanwhile, supply roll 311 provides a continuous strip of insulating material 312, made of same or similar material as strip 302. The insulating strip 312 is passed through spacer station 305, wherein spacers are formed or deposited on the top surface of the insulating strip 312. The insulating strip 302 passes through aligner station 318 wherein a liquid crystal aligner (e.g., PI (polyimide), PVA, SiOx, etc.) is deposited or adhered onto the insulating strip 302.

In liquid crystal station 308 liquid crystals are deposited onto the strip 302. The top and bottom films are then brought together and enter a sealing station 309, which seals the edges of the insulating strips 302 and 312. After sealing the film may be cut to size by sheers 322, and the cut edges may be sealed. The layer are then transferred to a stacker 326, which may optionally include adhesive applicator 320, to form a bond between the sublayers as the VDC film is formed from multiple sublayers stacked on top of each other.

Figure 1G:
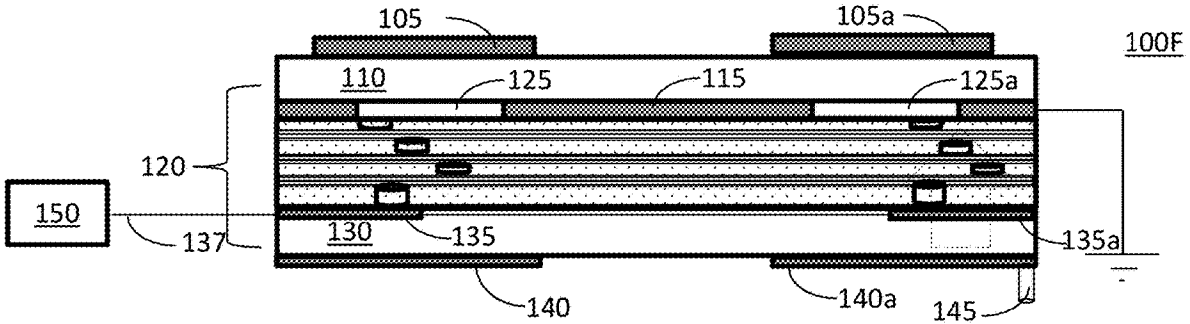
FIG. 1G illustrates a cross-section of an embodiment with multiple radiating patches

As disclosed above, all of the embodiments shown herein may be implemented by having multiple radiating patches, a feature illustrated in FIG. 1G, although for illustration purposes only two radiating patches, 105 and 105*a*, are shown in FIG. 1G. In this embodiment, the signal of each radiating patch is fed independently using signal lines 140 and 140*a*, via corresponding windows 125 and 125*a*. Also, the dielectric constant for each signal line is controlled independently by corresponding control lines 135 and 135*a*. Thus, when the multiple radiating patches are provided in an array, the dielectric for each signal line can be controlled independently, thereby introducing different delay to each line, thus steering or scanning the beam.

As noted above, VDC material has been used in the prior art; however, in certain RF and microwave devices, such as antenna, the active layer thickness must be relatively high, e.g., 50 to 500 μm (as a function of the antenna wavelengths and application technology). Higher active layer thickness results in a loss of the LC molecules alignment in the bulk, leaving only the LC molecules at both surfaces that are close to the alignment layer to be aligned. As a result of that, two things happen which degrade the antenna's performance and limit its use. First, since overall in the bulk the LC molecules are not aligned (in the voltage "off" state), they are oriented freely without a specific direction, and the starting, or voltage "off" state, dielectric constant value is higher than for pure planar aligned LC material. When the voltage is switched "on", above the threshold value, all LC directors change their orientation parallel to the electric field direction, albeit the effect may be stronger at the edges than at the bulk layer. The end result, or delta ε ($\Delta\varepsilon=\varepsilon_{\parallel}-\varepsilon\perp$) is lower than what could be reached if the starting, or "off" state was purely $\varepsilon\perp$. This loss of delta ε, between the "on" and "off" stages limits the antenna's performance and capabilities. Second, switching times are increased, from milliseconds to seconds when switching the voltage off, due to the lack of LC alignment at the bulk. Consequently, current technology cannot use LC at high thickness, due to lower dielectric performance and very slow switching times.

Conversely, by maintaining each of the active sublayer's thickness low, e.g., 5-50 μm, the LC molecules are aligned at both surfaces and throughout the bulk, at the "off" state, thereby achieving a faster response time ($\tau_{on}$, $\tau_{off}$) and reduced $\varepsilon\perp$ value, which also corresponds to a higher Δε. As a result, the overall performance of the phase modulator will be faster and able to achieve a higher phase modulation, or a larger beam steering angle. However, the more essential challenge arising for the system when using thin LC layers is the high dielectric and ohmic losses of the microstrip or stripline signal transmission line, and thus the overall performance of the antenna and or device degrades dramatically. Therefore, it is preferred to use a very specific and much higher substrate thickness. The total VDC layer's thickness is thus achieved by stacking multiple LC sublayers.

In accordance with disclosed embodiments, low-cost, thin layer liquid crystal (LC) phase modulators and phased array antenna designs are provided in which surface-aligned LCs are modulated reversibly with small applied electrical fields. The LC medium of each sublayer is placed in between two surfaces. An alignment layer is pre-deposited and preconditioned (e.g., by rubbing, photo-alignment, evaporation, etc.). A second LC layer is added on top of the thin polymer film, followed by another thin polymer film. The number of these repeating polymer film and LC layer thickness is not set, and can vary between different applications and device requirements.

The thin dielectric or polymer film separating the LC layers can be made of PE polyethylene, PP polypropelene, ABS, MAYLAR, PET, polyester, PTFE (including all flouro plastic compounds), Delrin, FEP, PFA, HALCAR ETPE, Hytrel (TPE), Polyurethane PU, Cirlex Kapton, Kapton (polyimide) type HN, VN, XC, MT and all other types of polyimide compounds, Nylon 6/6, PEEK, PEI ULTEM polyetherimide, PES ULTRASON, PC Polycarbonate, PPS (polyphenylene), PSU UDEL (Polysulfone Resin), PVDF/KYNAR (polyvynilidene fluoride Resin), Tefzel, TPX polymethypentene, PS polystyrene and co-polymers of any of the above mentioned polymers.

The thickness of the intermediate polymer films is recommended to be kept as thin as possible, e.g., 3-10 μm or 10-25 μm, up to 25-50 μm. When using LC layers, all surfaces in the device that are in contact with the LC are covered by an alignment material, e.g., PI (polyimide), PVA, SiOx, etc. All of the sub-layers are stacked together to form the PDLC/SLC layer.

Construction of the multilayered structure device requires the layers to be laid one on top of the other in a parallel and tight thickness control all over the area of the device. Spacers, made from material such as glass, PS (polystyrene), PE (polyethylene), PP (polypropylene), PMMA, Silica, Cellulose acetate, Zirconia, at the required diameter, may be distributed evenly on the surface to maintain the required gap all over the device area. An aligner film (after alignment material has been applied to, and given direction), may be laid upon the spacers. Adhesive/sealant material should be applied to the perimeter of the device to seal and prevent leakage of the LC material out of the device. Two opposite areas in the perimeter of the device may be initially kept without adhesive for LC insertion (by capillary or liquid injection, with or without a vacuum). The next layer up is constructed in the same manner: spacers are distributed to keep and maintain the gap uniformly, followed by another dielectric film. The multi-layer construction is built in this manner, until the final layer laid on the gap spheres is the opposite closing dielectric layer, closing the device—is laid. After the device layering is complete, LC insertion may take place. The final stage is sealing the insertion holes on both sided with a suitable sealant/adhesive material.

Figure 2A:
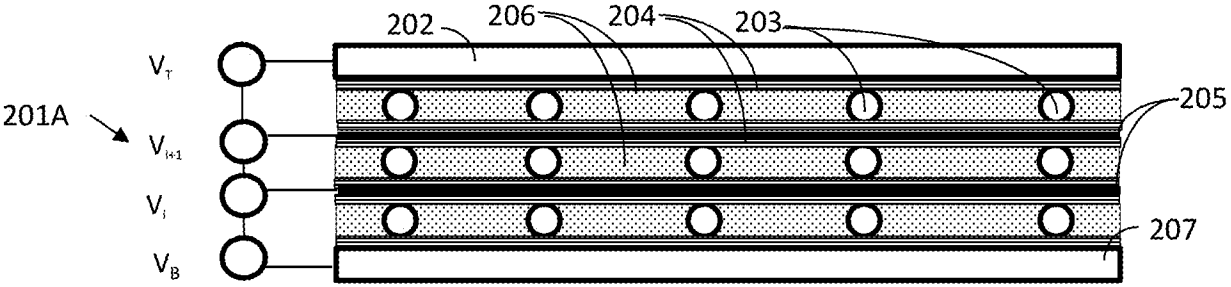
FIG. 2A illustrates an embodiment wherein the control signal is applied to each of the sublayers individually and in a progressive matter of increased voltage.

According to another embodiment, voltage is applied to each individual thin film, in a manner that the voltage applied to each film, $V_i$, is smaller than the total voltage $V_T$ and larger than the lowest voltage $V_B$. By building a multi-layer structure, in which the separating films are electrified, an electric field is created between the top and bottom layers of the device, but the overall operating voltage of the device is reduced. In order to have the separating films act as electrodes, they have to be made of metal or metal coated polymer films or have conductive control electrode applied to each thin layer. In FIG. 2A the variable voltage given to each layer is depicted, where $V_T$ is the voltage applied to the top dielectric layer, $V_B$ is the voltage applied to the bottom dielectric layer; $V_i$ and $V_{i+1}$ are the voltages applied to the separating films. During the "off" state, no voltage is applied to the multilayer structure, in the "on" state, voltage is applied in a manner that $V_T>V_{i+1}>V_i>V_B$.

Thus, a method for fabricating a multi layered phase modulator or antenna device separated internally by a thin polymer film coated on both sides by an alignment layer is provided, comprising: coating an alignment layer on a bottom dielectric layer and inducing directivity on the alignment layer; placing spacers on the alignment layer; coating a separating film with alignment material on both sides and inducing directivity in the alignment material; placing the separating film on top of the bottom dielectric layer; placing a second layer of spacers on top of the separating film; coating a top alignment layer on a top dielectric film and inducing directivity in the top alignment layer and placing the top dielectric layer on top of the separating film; and inserting liquid crystals between the bottom dielectric layer and the separating film and between the separating film and the top dielectric layer.

Similarly, a multilayer variable dielectric constant (VDC) device is provided, comprising: a bottom dielectric film; a top dielectric layer; at least two VDC layers sandwiched between the bottom dielectric layer and the top dielectric layer and in physical contact with each other; and, a separation layer positioned between each two variable dielectric constant layers. Each of the VDC layers may comprise: a bottom liquid crystal (LC) alignment layer; a top LC alignment layer; a plurality of spacers dispersed between the bottom LC alignment layer and the top LC alignment layer; a plurality of liquid crystals dispersed between the bottom LC alignment layer and the top LC alignment layer.

Figure 1H:
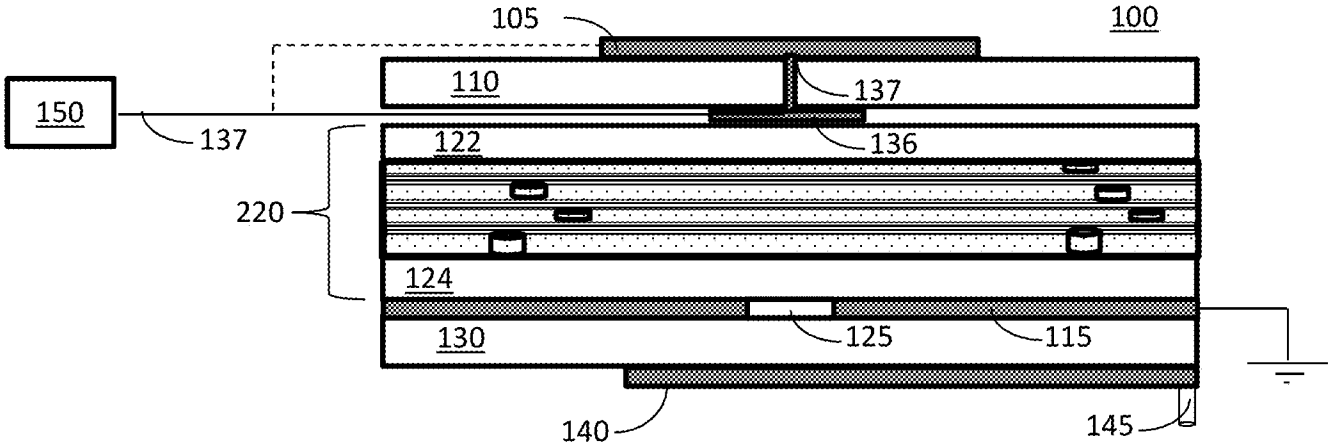
Figure 1I:
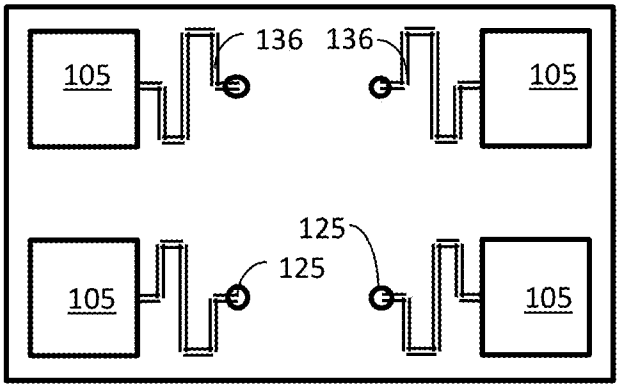
FIG. 1I is a top view thereof.

FIGS. 1H and 1I illustrate the implementation of the innovative VDC layer to a two-dimensional array, having 2×2 radiating patches 105, fed by corresponding delay lines 136. As shown in the cross-section of FIG. 1H, the delay line is provided above the VDC layer 220, while the ground plane 115 is provided below the VDC layer 220. A signal line 140 couples the signal to the delay line 136 via the window 125 in the ground plane 115. The controller 150 applies the control signal to the delay line 136, such that the liquid crystals in proximity to the delay line 136 are controlled by the signal generated by the controller 150. As noted above, in an alternative embodiment the control signal is applied incrementally to each successive sublayer of the VDC layer 220.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. An antenna comprising:
an RF connector;
a variable dielectric constant (VDC) layer;
a plurality of radiating patches provided over the VDC layer;
a plurality of delay lines, each connected to a corresponding one of the plurality of radiating patches;
a plurality of signal lines, each terminating in alignment below one of the delay lines and each coupled to the RF connector;
a plurality of control lines, each corresponding to one of the delay lines;
a ground plane, wherein the ground plane comprises a plurality of windows, each window aligned in a direct line of sight between one of the delay lines and a corresponding one of the signal lines;
wherein the VDC layer comprises a plurality of VDC sublayers stacked on top of each other; and,
wherein each signal line couples RF energy to one of the delay lines via a window in the ground plane.

2. The antenna of claim 1, wherein each of the plurality of VDC sublayers comprises a bottom film; a top film; and liquid crystals (LC) dispersed between the bottom film and top film.

3. The antenna of claim 2, further comprising a bottom LC alignment layer provided on the bottom film and a top LC alignment layer provided on the top film.

4. The antenna of claim 3, further comprising a plurality of spacers provided between the bottom film and the top film.

5. The antenna of claim 1, wherein the signal line is provided over the VDC layer and the ground plane is provided below the VDC layer.

6. The antenna of claim 1, wherein each of the delay lines is connected to a corresponding one of the plurality of control lines.

7. The antenna of claim 1, wherein the plurality of VDC sublayers comprise:
a bottom film;
a top film;
at least one separating film provided between the bottom film and top film; and,
liquid crystals dispersed between the bottom film, top film, and at least one separating film.

8. The antenna of claim 7, further comprising:
a bottom alignment layer provided on the bottom film;
a top alignment layer provided on the top film; and,
intermediate alignment layers provide on both sides of each of the at least one separating film.

9. The antenna of claim 1, further comprising a plurality of orthogonal signal lines each terminating in alignment below one of the delay lines and at an orthogonal direction to one of the plurality of signal lines.

10. The antenna of claim 9, further comprising a second ground plane.

11. The antenna of claim 10, wherein the second ground plane comprises a plurality of windows, each aligned in a direct line of sight between one of the delay lines and a corresponding one of the orthogonal signal lines.

12. The antenna of claim 9, further comprising a plurality of second control lines, each corresponding to one of the orthogonal signal lines.

13. The antenna of claim 9, further comprising a second VDC layer positioned between the plurality of signal lines and plurality of orthogonal signal lines.

14. The antenna of claim 1, wherein the plurality of control lines are distributed between the plurality of liquid crystals sublayers and configured to apply control signal to each of the liquid crystals sublayers.

15. An antenna comprising:

a dielectric plate;

a plurality of radiating patches provided on the dielectric plate;

a plurality of delay lines, each connected to a corresponding one of the plurality of radiating patches and coupling RF energy to one of the plurality of radiating patches;

a ground plane having a plurality of windows, wherein each of the of delay lines is aligned with one of the plurality of windows;

at least one signal line, wherein each signal line is configured for capacitively coupling RF signal to one of the delay lines through one of the windows; and, a variable dielectric constant (VDC) layer provided between the plurality of delay lines and the ground plane and comprising: a top dielectric film, a bottom dielectric film, at least one intermediate dielectric film provided between the top dielectric film and the bottom dielectric film, and VDC material provided between the top dielectric film, the bottom dielectric film, and the at least one intermediate dielectric film.

16. The antenna of claim 15, further comprising:

a bottom alignment layer provided on the bottom dielectric film;

a top alignment layer provided on the top dielectric film; and, intermediate alignment layers provide on both sides of each of the at least one intermediate dielectric film.

17. The antenna of claim 16, further comprising a plurality of control lines, each corresponding to one of the signal lines.

18. The antenna of claim 16, further comprising:

a plurality of second signal lines positioned below the at least one signal line; and, a second ground plane.

19. The antenna of claim 15, further comprising:

a bottom VDC electrode provided at the bottom dielectric film;

a top VDC electrode provided on the top dielectric film;

a plurality of control lines, wherein at least one control line applies potential at the top VDC electrode, at least one control line applies potential at the bottom VDC electrode, and at least one control line applies potential at the intermediate dielectric film.

* * * * *